United States Patent [19]

Dinitz et al.

[11] Patent Number: 4,826,228

[45] Date of Patent: May 2, 1989

[54] UNIVERSAL SAFETY LIFTING DEVICE

[75] Inventors: Arthur M. Dinitz; Shepard C. Ozeroff, both of New Rochelle, N.Y.

[73] Assignee: Transpo Industries, Inc., New Rochelle, N.Y.

[21] Appl. No.: 120,912

[22] Filed: Nov. 13, 1987

[51] Int. Cl.[4] ..... B66C 1/14

[52] U.S. Cl. ..... 294/81.56; 294/67.1; 294/74; 294/81.2; 294/82.1

[58] Field of Search ..... 294/67.1, 67.3, 67.4, 294/67.41, 68.3, 74, 81.1, 81.2, 81.3, 81.55, 81.56, 81.5, 82.1, 82.11–82.13, 119.2

[56] References Cited

U.S. PATENT DOCUMENTS

| | | | |
|---|---|---|---|
| 158,434 | 1/1875 | Newcomb | 294/81.56 X |
| 819,576 | 5/1906 | McCabe | 294/81.55 X |
| 1,918,007 | 7/1933 | Woodruff | 294/68.3 |
| 2,020,174 | 11/1935 | Derossi | 294/81.55 |
| 2,226,294 | 12/1940 | Erickson | 294/67.41 |
| 2,676,835 | 4/1954 | McKinney | 294/74 |
| 2,696,317 | 12/1954 | Toffolon | 294/81.56 X |
| 2,721,757 | 10/1955 | Anderson | 294/81.56 X |
| 2,793,905 | 5/1957 | Hillyer | 294/67.3 X |
| 3,588,163 | 6/1971 | Wald | 294/67.3 X |
| 4,060,269 | 11/1977 | Rieger et al. | 294/74 X |

FOREIGN PATENT DOCUMENTS

| | | | |
|---|---|---|---|
| 1404546 | 5/1965 | France | 294/82.12 |
| 2059914 | 4/1981 | United Kingdom | 294/81.1 |

*Primary Examiner*—Johnny D. Cherry
*Attorney, Agent, or Firm*—Lilling & Greenspan

[57] ABSTRACT

A universal safety device includes, in one embodiment, a cross bar frame and, in another embodiment, a flat platform. Cables extend through the frame or platform, with gripping brackets at the lower ends of the cables configurated and dimensioned to secure lower gripping surfaces of an item to be lifted or moved, such as the lips or lifting rims, or lower recesses or indentations typically provided of sand-filled inertial barriers or crash cushions. Locking members are provided for maintaining the brackets in engagement with the lower gripping surfaces of the items to be lifted and a girth cable or belt is placed around the item to be lifted which circumscribes the downwardly depending cables to prevent accidental release thereof during lifting or movement.

16 Claims, 4 Drawing Sheets

FIG.8
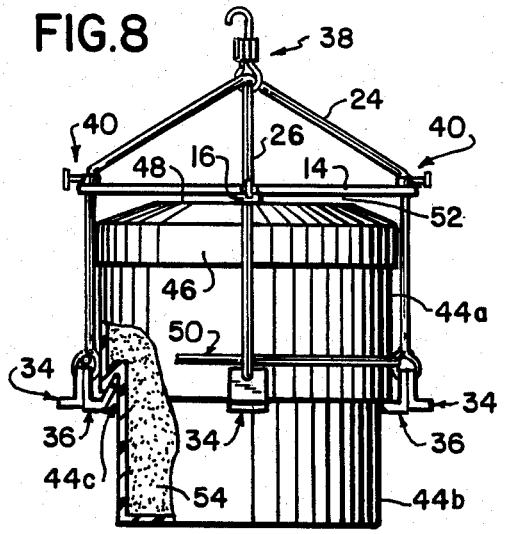
FIG.9
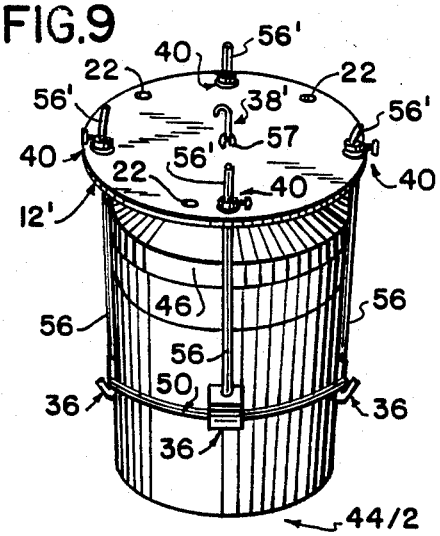
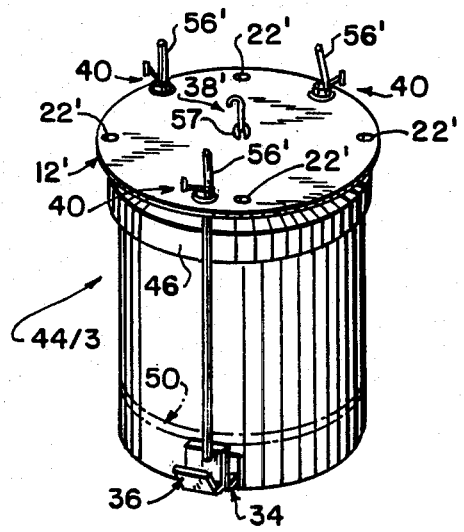
FIG.11
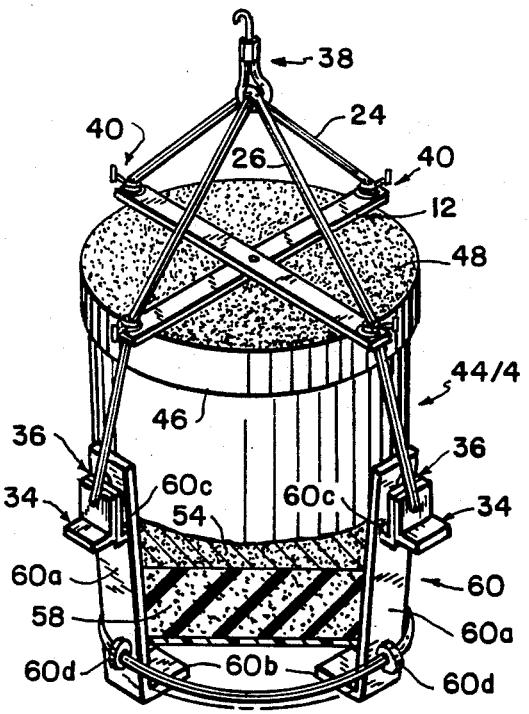
FIG.12

UNIVERSAL SAFETY LIFTING DEVICE

BACKGROUND OF THE INVENTION

1. Field of the Invention

This invention generally relates to mechanical lifting devices, and particularly to a lifting device which can be used by one man for lifting and moving heavy and bulky items safely, substantially independently of the shape, size or weight of the item being lifted.

2. Description of the Prior Art

In lifting and/or moving an item, due consideration must be given to its size, shape and weight. One or more of these factors may be crucial in determining whether one or more individuals must be used to lift and/or move an item, particularly in the field, such as at a construction site. For example, at highway construction sites, various barriers must continuously be moved to divert vehicular traffic to detour around the areas of construction to provide for the safety of the workers and for the safe operation of equipment. As highway construction progresses, the barriers must be moved to the next succeeding construction zone. The barriers which are used vary and may include concrete median barriers, steel median barriers and/or sand-filled plastic modules--sometimes referred to as "sacrificial crash cushions" or "inertial barriers". All of these barriers are large, heavy and bulky and cannot be conveniently lifted or moved by a single individual. Even when mechanical hoisting equipment is utilized, frequently more than one individual must be used to secure the barriers and safely lift and move the barriers since the accidental dropping of most barriers, particularly the concrete median barriers and the sand filled crash cushion barriers, can cause damage, be rendered useless if dropped and, of course, can cause injury to personnel.

The devices which have been used to date to move large, heavy and/or bulky items, particularly in the field, have been unsatisfactory either because they were not universal and were specifically designed only to lift and/or move a particular item; they required more than one individual to use; they were cumbersome and inconvenient to use; and/or they did not provide the degree of safety to personnel, equipment and/or the items that were being lifted and moved.

SUMMARY OF THE INVENTION

In order to overcome the disadvantages inherent in the prior art lifting devices, the universal safety lifting device in accordance with the present invention is used for lifting items having lower gripping surfaces. The device comprises a frame and a plurality of cables extending downwardly from said frame. Engaging means are provided at the lower ends of each of said cables for engaging the lower gripping surfaces of the item to be lifted. The lengths of said cables below said frame are adjustable, whereby after each engaging means has engaged a lower gripping surface of the item to be lifted, the associated cable can be adjusted to secure each engaging means to an associated lower gripping surface of the item to be lifted. Locking means are provided for locking each cable in relation to said frame after the length of each cable has been adjusted to maintain said engaging means in abutment with the associated lower gripping surfaces. In this manner, the raising of said frame safely lifts the item secured to said engaging means by said cables.

In accordance with one feature of the present invention, the item to be lifted defines an upper bearing surface and said cables are adjusted to securely position the lower bearing surface of the frame into abutment against the upper bearing surface of the item to be lifted. For some items to be lifted, such as crash cushion barriers, this further assures that they will not be inadvertently released and increases the margin of safety during the lifting and/or movement of such barriers.

BRIEF DESCRIPTION OF THE DRAWINGS

For a better understanding of the invention together with other and further objects, features and advantages thereof, as well as other characteristics of various embodiments thereof, reference is had to the following description taken in conjunction with the accompanying drawings in which:

FIG. 8 is similar to FIG. 7, but shown in side elevation and being partially broken away to illustrate the manner in which the lifting device engages the lip or lifting rim of the crash cushion;

FIG. 9 illustrates another embodiment of the lifting device in the form of a circular plate, and further showing the manner in which such lifting device is used to lift a crash cushion which is tapered;

FIG. 11 is similar to FIG. 9, but showing the manner in which the lifting device is used to engage a crash cushion provided with indentations or recesses at the lower end of the crash cushion;

FIG. 12 is similar to FIGS. 4, 6 and 7, and being partially in cross-section to show the manner in which the cross bar lifting device can be used with enlarged L-shaped brackets to lift crash cushion barriers which have soft bottoms;

DESCRIPTION OF THE PREFERRED EMBODIMENTS

Figure 1:
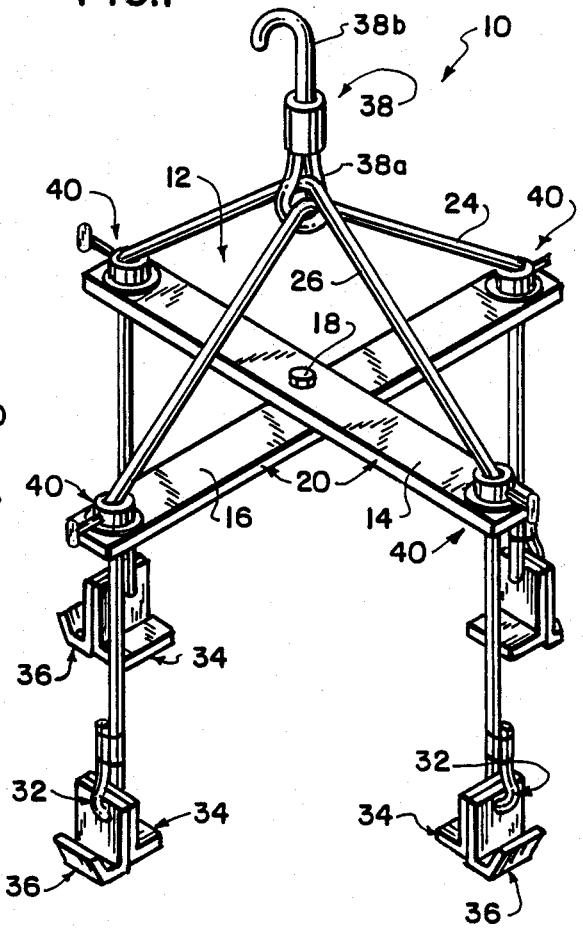
FIG. 1 is a perspective view of a cross bar lifting device in accordance with the present invention.

Referring now specifically to the Figures, in which the identical or similar parts are designated by the same reference numerals throughout, one presently preferred embodiment of a universal safety lifting device in accordance with the present invention is shown in FIG. 1 and identified by the reference numeral 10. In this embodiment, the lifting device is in the form of a cross bar lifter which includes a platform or frame 12 formed by cross bars or cross members 14 and 16 which are advantageously pivotly secured to each other by means of a connecting bolt 18. The cross bars 14, 16 define lower bearing surfaces 20, the importance of which will become apparent hereafter. At the free end of each of the cross bars 14, 16, there are provided holes 22 (FIG. 2) through which cables 24, 26 can freely pass with clearance therebetween.

Figure 2:
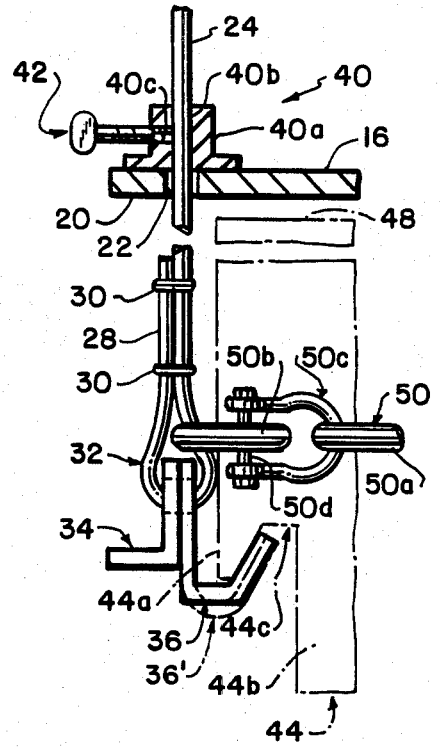
FIG. 2 is an enlarged side elevational view, partially in cross-section, of one end of one of the cross members of the cross bar lifting device shown in FIG. 1, showing the details of the lifting device for engaging the item to be lifted and for locking the device for maintaining the engaged condition.
Figure 3:
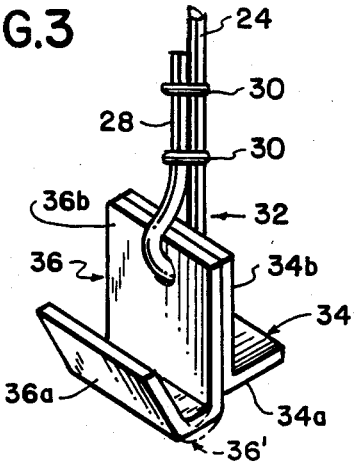
FIG. 3 is an enlarged view, in perspective, of the end of one of the cables shown in FIGS. 1 and 2, showing the shapes of the engaging brackets in accordance with the present invention.

Referring to FIGS. 2 and 3, the free ends 28 of each of the cables 24, 26 are folded over and secured by means of cable clips 30 to form lower loops 32. The cable clips 30 are only exemplary and any means can be used to create the lower loops 32.

Referring particularly to FIG. 3, the loop 32 is shown to support an L-shaped bracket 34 which has a lower, substantially horizontal portion 34*a* and a vertical portion 34b in which the hole is provided for the loop 32. Similarly, a V-shaped bracket 36 is shown, back-to-back with the L-shaped bracket 34, which has an inclined portion 36a and a vertical portion 36b through which the loop 32 passes. The angle at which the inclined portion 36*a* forms with the horizontal is not critical for the purpose of the present invention and may be selected to correspond with the items to be lifted, as will become more apparent hereafter. As should be clear, the brackets can assume any desired shape including U-shaped, as suggested by the phantom outline 36′ in FIGS. 2 and 3.

In the embodiment shown in FIGS. 1–3, the cables 24, 26 are two cables which extend across the tops of the respective cross bars 14, 16, with the ends of these cables extending through the associated holes 22 to engage the brackets 34, 36. In this embodiment, there may be provided a lifting member 38 which includes a lower loop 38a which engages the cables 24, 26 as shown, and a lifting hook 38b to facilitate the lifting and movement of the platform or frame 12 and the items to be lifted.

A feature of the invention, the object of which will become apparent hereafter, is the provision of a cable clamp or lock 40 for locking each cable in relation to the frame 12 after the length of each of the cables 24, 26 has been adjusted, for reasons to be described. Referring to FIG. 2, the cable clamp or lock 40 is shown, by way of example, to consist of a clamp body 40*a* provided with a vertical longitudinal hole 40*b* dimensioned to receive the cables 24, 26 with small clearance and a threaded side hole 40*c*. A butterfly clamping bolt 42 is received within the threaded side hole 40*c* and can be advanced into same to tighten against the respective cables 24, 26 to lock same in place. As should be evident, once the clamping bolt 42 is tightened, the cables 24, 26 become locked in place in relation to the associated cross members 14, 16 thereby fixing the distances between the cross bars 14, 16 and the brackets 34, 36. Any other clamping or locking device may be used. For example, the clamping device may be a spring-loaded clamp or any other clamp which will perform the required function.

Referring to FIGS. 2 and 4–6, the operation of the cross bar 10 will be described when used to lift and move a sand-filled inertial barrier or crash cushion 44. Crash cushions 44 of the type shown are generally made of plastic or other frangible material and filled with sand to absorb the impact of a moving vehicle resulting in sand and plastic parts scattering in the directions of impact. The crash cushion 44 is shown to include an upper portion 44*a* having a larger diameter and a lower portion 44*b* having a smaller diameter to form a lip or lifting rim 44*c* which defines a lower gripping surface. In FIG. 2, the lower gripping surface 44*c* includes an inverted surface which is inclined at an angle substantial corresponding to the angle of inclination of the inclined portion 36a of the V-shaped bracket 36 so as to insure the maximum area of contact between the contacting or abutting surfaces.

Figure 6:
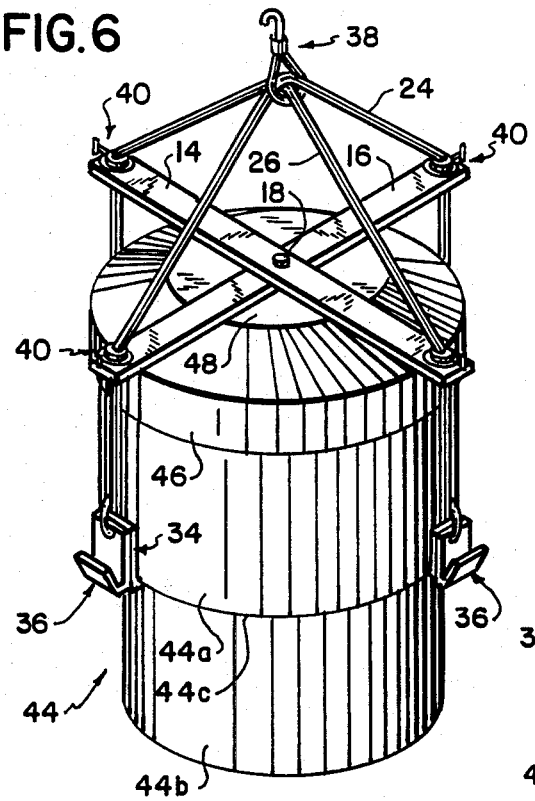
FIG. 6 is similar to FIG. 5, but showing the lifting device and crash cushion in perspective.
Figure 4:
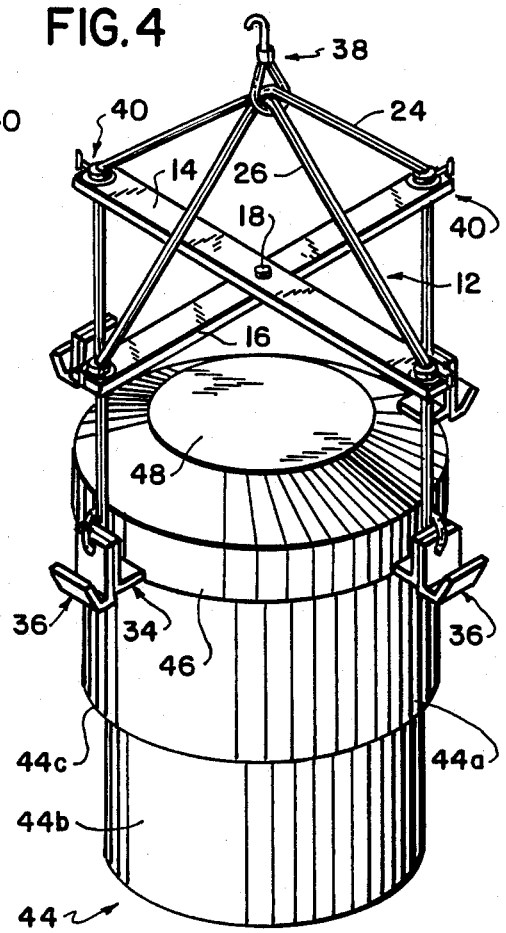
FIG. 4 is a perspective view of the cross bar lifting device shown in FIGS. 1–3, in the process of being lowered onto a sand filled inertial barrier or crash cushion and prior to engagement therewith.
Figure 5:
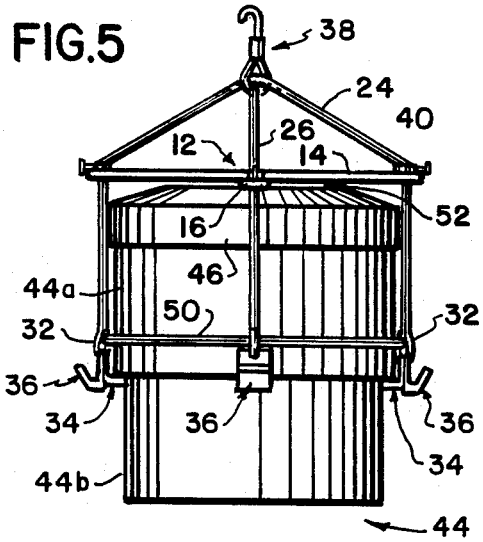
FIG. 5 is a side elevational view of the lifting device and crash cushion shown in FIG. 4, showing the relationship of the various elements after engagement and locking.

The crash cushion 44 also includes a cover 46 which defines an upper bearing surface 48. In operation, the cross bar lifter 10 is lowered over the crash cushion 44 by any suitable hoist or other piece of equipment in the field which can engage the lifting hook 38 to lower and raise the lifter. In FIG. 4, the frame or platform 12 is shown being lowered over the crash cushion to be lifted and moved. In FIGS. 5 and 6, the platform is shown in its final position, wherein the lower surface 20 of the lower cross bar 16 is shown in abutting engagement against the upper surface 48 of the crash cushion 44. Since the upper cross bar 14 is spaced above the cross bar 16, there will be created a space 52 between the lower surface 20 of the cross bar 14 and the upper bearing surface 48 of the crash cushion. The space 52, however, may be made relatively small so that the crash cushion 44 can still be lifted and moved with substantial stability and safety.

Once the frame or platform 12 has been brought into engagement with the crash cushion 44, the V-shaped brackets are engaged with the lip or lifting rim 44*c* as suggested in FIG. 2 and the cables 24, 26 are raised in relation to the frame 12 so as to take out slack in the cables between the frame and the supporting brackets. In the conditions shown in FIGS. 5 and 6, the cable clamps or locks 40 are tightened to maintain the upper surface 48 of the crash cushion 44 in abutment against the frame 12, and particularly against the lower surface 20 of the cross bar 16. As should be evident, in the adjusted conditions of the cross bar lifter 10 as shown in FIGS. 5 and 6, the crash cushion 44 can be safely raised and moved without accidental release of the crash cushion.

Another feature of the present invention is a girth cable 50 which is arranged around the circumferential surface of the crash cushion 44 and engages the lower ends of the cables 24, 26 and/or the brackets 34, 36 in order to still further insure that the brackets will no inadvertently separate from the lower gripping surfaces defined by the lip or lifting rim 44*c*. Thus, the girth cable 50 serves as a safety feature to prevent inadvertent release of the item being raised or moved.

Referring to FIG. 2, one method of using the girth cable 50 is shown, wherein the cable is provided with a first loop 50*a* at one end thereof and a second loop 50*b* at the other end thereof. A locking ring 50*c* provided with a bolt 50d is shown which can be used to selectively lock and disconnect the loops 50a and 50b to or from each other. In FIG. 2, the girth cable 50 is shown to pass through the loop 32 at the lower end of the cable 24 although, as suggested, the girth cable can also directly engage the brackets 34 or 36 without passage through the loops 32. The girth cable can take any desired or suitable form, and can be in the nature of a fiberglass or webbing belt, the ends of which can be secured to each other in any suitable manner, including the use of buckles, hooks, tie backs or the like.

Figure 7:
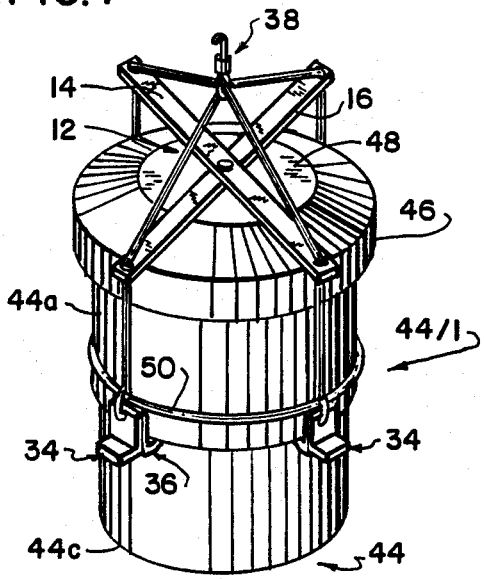
FIG. 7 is similar to FIG. 6, but showing the cross bar lifting device used to lift a crash cushion having a differently shaped lip or lifting rim of the type suggested in phantom outline is FIG. 2.

While the lip or lifting rim 44c in FIGS. 4–6 is in the nature of a horizontal surface which can properly be engaged by the lower portions 34a of the L-shaped brackets 34, the crash cushion 44/1 shown in FIG. 7 is provided with an inclined surface of the type shown in FIG. 2 which can more properly be engaged with the V-shaped brackets 36. In the embodiment being described, the choice between the two brackets 34, 36 can simply be made by rotating these brackets into place prior to engagement of the lip or lifting rim. In other respects, the construction of the frame 12 and the operation thereof is the same as described in connection with FIGS. 1–6. In FIG. 8, a portion of the crash cushion is broken away to more clearly illustrate the manner in which the V-shaped bracket bracket 36 engages the lip or lifting rim 44c and the sand 54 which fills the crash cushion.

Figure 10:
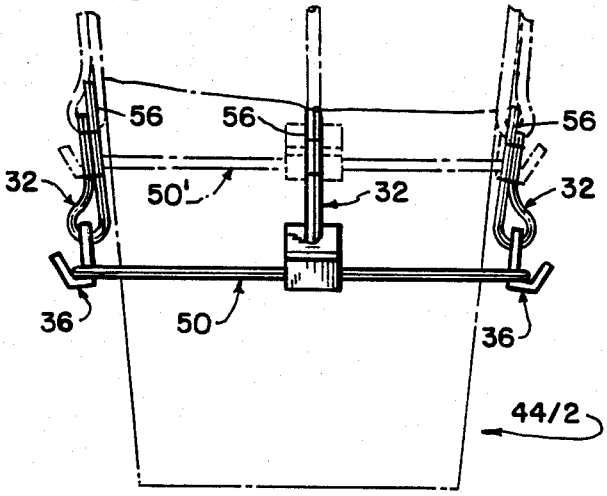
FIG. 10 is similar to FIG. 9, but showing the manner in which a girth cable is used to engage the tapered crash cushion, which is shown in phantom.

Referring to FIG. 9, an alternate embodiment of the lifter is shown which includes a substantially flat circular platform or frame 12' provided with peripheral holes 22. In this embodiment, the cables 56 are sufficiently long so as to form portions 56' above the platform 12' which can be used for adjusting the lengths of the cables 56 below the platform. In FIG. 9, the crash cushion 44/2 is in the nature of a tapered barrel which defines a lower gripping surface when engaged by the girth cable 50 raised to the appropriate height where the circumference or periphery of the barrel is substantially equal to the length of the girth cable 50. With the V-shaped brackets 36 engaging the girth cable 50, each of the cables 56 is raised in relation to the platform 12' until the girth cable has reached its maximum upper axial distance in relation to the crash cushion 44/2 and the cable clamps or locks 40 are locked as previously described. In FIG. 9, four cables 56 are shown spaced 90° from each other, and a lifting hook 38' is secured to the center of the platform by any suitable means, such as loop 57. The advantage of the platform 12' is that is present a larger lower bearing surface 20, so that it can abut against the entire upper bearing surface 48 of the crash cushion thereby substantially eliminating spaces 52 of the type associated with the cross bar lifter 10. After the platform 12' has been securely adjusted into abutment against the crash cushion 44/2, the entire assembly can be lifted and moved with assurance that the crash cushion will not be inadvertently dropped. In FIG. 10, the girth cable 50 is shown when first engaged by the V-shaped brackets 36 and, in phantom outline, the position at 50' where the cables 56 have been sufficiently raised to tighten the girth cable 50 around the tapered crash cushion to permit lifting and movement of same.

In FIG. 11, a modified form of crash cushion 44/3, which is commonly used, is shown. Typically, such crash cushions include lower indentations or recesses. Frequently, such recesses are provided along the lower rim of the crash cushion and spaced from each other 120°. For this purpose, for example, the alternate set of holes 22 shown in FIG. 9 can be used which are spaced 120° apart from each other to correspond with the spacing of the lower indentations or recesses in the crash cushion. Otherwise, the operation of the platform 12' is as described for FIGS. 9 and 10.

Some crash cushions are provided with soft bottoms which are more difficult to move since the lifting of such crash cushions could result in the sand 54 forcing the soft bottom, such as the Styrofoam section 58, through the bottom of the barrel. In order to facilitate the lifting of such crash cushions 44/4, as shown in FIG. 12, there are advantageously provided larger L-shaped brackets 60 which include upright portions 60a and lower, horizontal portions 60b which can be wedged under the crash cushion 44/4 in any suitable way to engage and prevent the relative movement of the soft bottom 58 in relation to the barrel itself. In order to permit the lifting of the L-shaped brackets 60, there is advantageously provided a slot 60c at the upper ends thereof, as shown, dimensioned to receive the L-shaped bracket 34, the V-shaped bracket 36, or both. As with the other embodiments, in order to prevent inadvertent movement or separation of the brackets after engagement and during lifting, the brackets 60 are preferably provided with loops 60d, which can be welded to the brackets, through which the girth cable 50 can pass and prevent inadvertent separation. In those cases where, for example, a barrel having straight sides does not have a soft bottom, the horizontal portions 60b can be made shorter.

Figure 13:
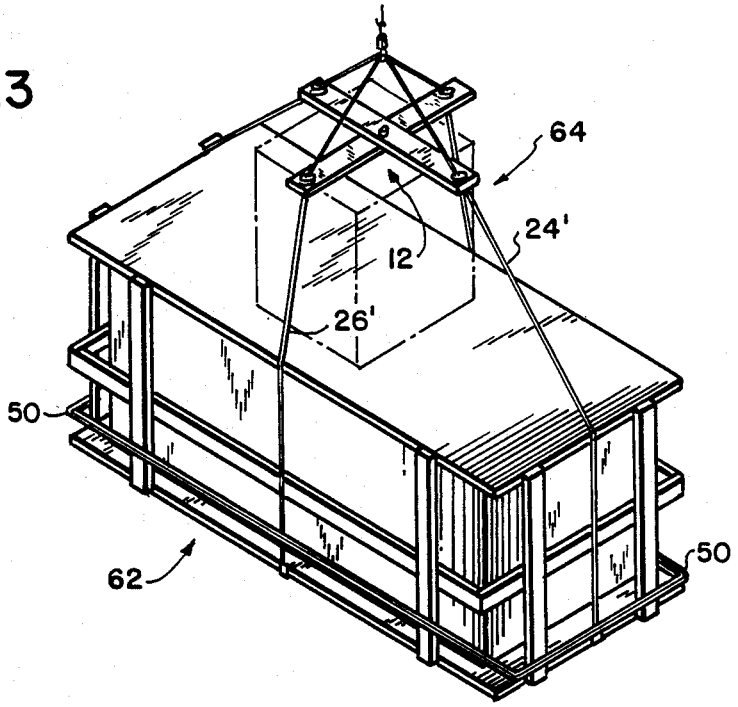
FIG. 13 is a perspective view illustrating the manner in which the cross bar lifting device can be used to lift a loaded square pallet load, and showing in phantom outline an optional filter or spacer to further secure the load.
Figure 14:
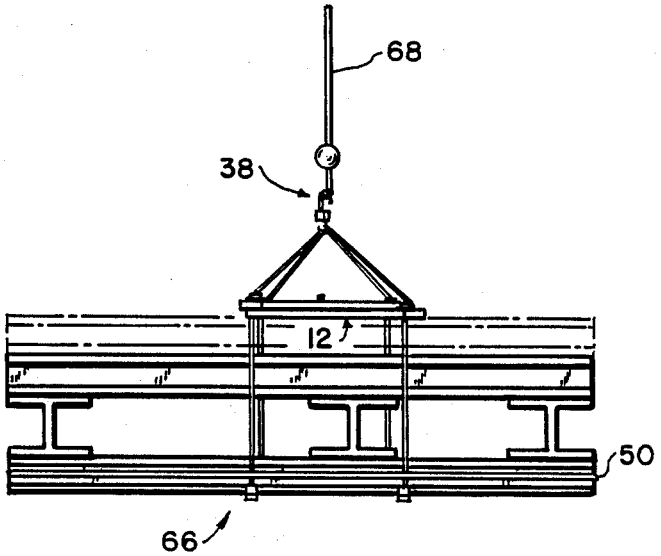
FIG. 14 is a side elevational view illustrating the manner in which the cross bar lifting device can be used to lift long steel loads.

FIG. 13 illustrates another application of the cross bar lifter to lift a loaded square pallet load 62. Consistent with the above description, suitable lower gripping surfaces are provided on such load 62 suitable for engaging brackets 34, 36 or both. If desired, an optional filler or spacer 64 can be provided for filling the space between the frame or platform 12 and upper surface of the pallet load 62 to avoid possible movement or separate of the cables from the load during lifting or movement. In some instances, however, particularly with a load of the type shown in FIG. 13, it may not be necessary to utilize the optional filler or spacer 64. Similarly, in FIG. 14, the cross bar lifter is shown to lift long steel loads 66. For reasons previously described, the lower bearing surfaces 20 of the cross bars 14, 16 preferably engage the upper bearing surface of the steel load. Again, however, with certain types of loads and the conditions under which lifting or movement is to take place, this may not be entirely necessary.

As should be evident, the lifting devices, in the embodiments shown or in equivalent modified forms, can be used by one man in the field to lift and move heavy and bulky items in a safe and reliable manner.

While the invention is described with reference to specific embodiments thereof and with respect to the incorporation therein of certain combinations of features, it is to be understood that the invention may be embodied in other forms, many of which do not incorporate all of the features present in this specific embodiment of this invention which has been described. For this reason, the invention is to be taken and limited only as defined by the claims that follow.

What is claimed is:

1. Universal safety lifting device for lifting items having upper bearing surfaces and lower gripping surfaces, the device comprising support means; a plurality of cables depending downwardly from said support means and defining lower free ends; a frame having a lower bearing surface and a plurality of holes for passage of each of said plurality of cables through said frame to dispose said lower free ends of said cables below said frame; engaging means attached to said lower free ends of said cables for engaging the lower gripping surfaces of the item to be lifted, the position of said frame being adjustable in the vertical direction and angularly tiltable in relation to the horizontal by passage of selective lengths of said cables through various ones of said frame holes, whereby after each engaging means has engaged a lower gripping surface of the item to be lifted said frame can be adjusted in relation to said cables to securely position the lower bearing surface of said frame into abutment against the upper bearing surface of the item to be lifted; and locking means for locking each cable in relation to each frame after the length of each cable has been adjusted to maintain the item to be lifted in abutment against said frame, whereby the raising of said frame safely lifts the item secured to said frame by said cables.

2. Lifting device as defined in claim 1, wherein said frame comprises two pivoted cross bars to form an X-shaped frame, said cross bars being provided with holes at the end of each cross bar for passage of said cables.

3. Lifting device as defined in claim 2, wherein two cables are provided, each cable bridging the top of another one of said cross bars and having the free ends thereof extending downwardly through said holes of the associated cross bar, each free end being connected to an engaging means, whereby the bridging portion of each cable above the associated cross bar can be seized and lifted by said support means.

4. Lifting device as defined in claim 1, wherein said locking means comprises cable clamps above said frame, each for locking another of said cables in relation to said frame, whereby a locked cable is prevented from moving downwardly below said frame and the spacing between said frame and an associated engaging means cannot be increased.

5. Lifting device as defined in claim 1, wherein said support means comprises a lifting hook for engaging said cables above said frame for facilitating lifting of said cables and frame.

6. Lifting device as defined in claim 1, wherein the item to be lifted is a cylindrical member having an inverted V-shaped lip extending about the periphery thereof, and said engaging means comprises a V-shaped bracket at the end of at least one of said cables suitable for being received in the V-shaped lip.

7. Lifting device as defined in claim 6, wherein a V-shaped bracket is provided at the end of each of said cables.

8. Lifting device as defined in claim 1, wherein the item to be lifted is a cylindrical member provided with at least one downwardly facing horizontal bearing surface, and said engaging means comprises an L-shaped bracket at the end of at least one of said cables suitable for engaging said horizontal bearing surface.

9. Lifting device as defined in claim 8, wherein an L-shaped bracket is provided at the end of each of said cables.

10. Lifting device as defined in claim 1, wherein said frame comprises a flat plate provided with peripheral holes for passage of said cables.

11. Lifting device as defined in claim 10, wherein said plate is circular.

12. Lifting device as defined in claim 11, further comprising a lifting hook at the center of said plate for facilitating lifting of said cables and frame.

13. Lifting device as defined in claim 1, further comprises encircling cable means for encircling the girth of the item to be lifted in the region of said engaging means in the adjusted conditions of said cables to prevent lateral movements of said engaging means and thereby assure continued abutment between said engaging means and the lower gripping surfaces during lifting and movement of the item.

14. Lifting device as defined in claim 13, whrein said encircling means comprises a cable.

15. Lifting device as defined in claim 13, wherein said encircling means comprises a belt.

16. Lifting device as defined in claim 13, wherein the item is downwardly tapered to create a lower gripping surface, and said encircling cable means engages the lower gripping surface, said engaging means engaging said encircling cable means when the item is lifted.

* * * * *